US009564085B2

(12) United States Patent
Jin et al.

(10) Patent No.: US 9,564,085 B2
(45) Date of Patent: Feb. 7, 2017

(54) SELECTIVE DIMMING TO REDUCE POWER OF A LIGHT EMITTING DISPLAY DEVICE

(71) Applicant: Dialog Semiconductor Inc., Campbell, CA (US)

(72) Inventors: Xuecheng Jin, Palo Alto, CA (US); Gyan Tiwary, Saratoga, CA (US)

(73) Assignee: Dialog Semiconductor Inc., Campbell, CA (US)

( * ) Notice: Subject to any disclaimer, the term of this patent is extended or adjusted under 35 U.S.C. 154(b) by 0 days.

(21) Appl. No.: 13/890,493

(22) Filed: May 9, 2013

(65) Prior Publication Data

US 2013/0314454 A1 Nov. 28, 2013

Related U.S. Application Data

(60) Provisional application No. 61/652,205, filed on May 27, 2012.

(51) Int. Cl.
*G09G 3/34* (2006.01)
*G09G 3/30* (2006.01)

(52) U.S. Cl.
CPC ..... *G09G 3/3406* (2013.01); *G09G 3/30* (2013.01); *G09G 2320/0686* (2013.01); *G09G 2330/021* (2013.01); *G09G 2360/16* (2013.01)

(58) Field of Classification Search
CPC ..... G09G 2320/0686; G09G 2330/021; G09G 2360/16; G09G 3/30; G09G 3/3406
See application file for complete search history.

(56) References Cited

U.S. PATENT DOCUMENTS 7,760,210 B2 * 7/2010 Plut ..... G06F 1/3203 345/690
8,441,503 B2 * 5/2013 Isobe ..... G09G 3/22 345/102
2006/0087502 A1 * 4/2006 Karidis et al. ..... 345/211
(Continued)

FOREIGN PATENT DOCUMENTS

CN 101373579 A 2/2009
CN 101385071 A 3/2009
KR 10-2007-0106413 A 11/2007

OTHER PUBLICATIONS

Wikipedia, "LED-backlit LCD display," Feb. 2, 2012, 5 pages, [online] [retrieved on Dec. 9, 2013], Retrieved from the Internet <http://en.wikipedia.org/w/index.php?title=LED-backlit_LCD_display&oldid=474553322>.

(Continued)

*Primary Examiner* — Latanya Bibbins
(74) *Attorney, Agent, or Firm* — Fenwick & West LLP

(57) ABSTRACT

Selective dimming in a light emitting display device to reduce power consumption. The display device includes a display panel that includes a plurality of light emitting pixels. An image processor is configured to divide an image frame into a plurality of regions and to reduce pixel intensity levels in at least one region of the plurality of regions to generate an adjusted image frame. The at least one region corresponds to a background of the image frame. A display driver converts data for the adjusted image frame into control signals for controlling brightness of the light emitting pixels. The display device may be, for example, an organic light emitting diode (OLED) display device or other type of display device that includes light emitting pixels.

10 Claims, 5 Drawing Sheets

(56) References Cited

U.S. PATENT DOCUMENTS

| | | | | |
|---|---|---|---|---|
| 2009/0051637 | A1 | 2/2009 | Chen et al. | |
| 2009/0257678 | A1* | 10/2009 | Chen | G09G 5/10 382/274 |
| 2010/0039451 | A1* | 2/2010 | Jung | 345/690 |
| 2010/0149223 | A1* | 6/2010 | Betts-Lacroix | 345/690 |
| 2011/0148940 | A1* | 6/2011 | Byun et al. | 345/690 |
| 2011/0148941 | A1* | 6/2011 | Kim et al. | 345/690 |
| 2012/0256971 | A1* | 10/2012 | Shin et al. | 345/690 |

OTHER PUBLICATIONS

Chinese First Office Action, Chinese Application No. 201310203871.9, Dec. 26, 2014, 30 pages.

Korean Office Action, Korean Application No. 10-2013-0058449, May 30, 2014, 8 pages.

Chinese Second Office Action, Chinese Application No. 201310203871.9. Aug. 4, 2015, 13 pages.

* cited by examiner

SELECTIVE DIMMING TO REDUCE POWER OF A LIGHT EMITTING DISPLAY DEVICE

CROSS-REFERENCE TO RELATED APPLICATION

This application claims priority from U.S. Provisional Patent Application No. 61/652,205, filed on May 27, 2012, the contents of which are incorporated by reference herein in their entirety.

BACKGROUND

1. Field of the Disclosure

The present disclosure relates to a light emitting display devices, and more specifically to using selective dimming to reduce power consumption of a light emitting display device.

2. Description of the Related Arts

In many electronic devices, the display is responsible for a significant portion of the power consumed by the device. For devices such as flat panel monitors, reducing the power consumed by the displays is important for complying with federal regulations, such as the Energy Star requirements set by the Environmental Protection Agency (EPA). For mobile devices that include displays, reducing the power consumed by the displays is also important for maximizing battery life.

Until now, one of the more popular displays technologies has been liquid-crystal display (LCD) technology. LCDs use a backlight in conjunction with a passive front display panel that controls the amount of light that is allowed to pass through the display panel. In LCD display devices, the pixels of the LCD panel only consume a small amount of power. The backlight is responsible for a bulk of the power consumed by a LCD display device and can be dimmed to reduce power consumption.

Recently, newer displays using light emitting technology, such as active light emitting diode (LED) displays and organic light emitting diode (OLED) displays have begun to replace LCDs. Light emitting displays can include many (e.g. millions) of individual light emitting pixels, each of which emits a small amount of light when activated. Light emitting displays offer better color quality and viewing angles than LCDs and are generally more power efficient than LCDs due to the lack of a backlight. However, because light emitting displays include so many light emitting elements, they tend to consume a high amount of power when displaying white images and are thus relatively inefficient for use with computer based content such as web pages and word documents.

SUMMARY

Embodiments of the present disclosure include a light emitting display device with selective dimming to reduce power consumption. In one embodiment, the display device includes a display panel that includes a plurality of light emitting pixels, such as OLEDs. An image processor is configured to divide an image frame into a plurality of regions and to reduce pixel intensity levels in at least one region of the plurality of regions to generate an adjusted image frame. The at least one region corresponds to a background area of the image frame, for example, an area of the image frame that lacks useful information such as text and graphics. A display driver converts data for the adjusted image frame into control signals for controlling brightness of the light emitting pixels.

Beneficially, by reducing intensity levels in background regions of an image frame, areas of the image frame that do not include useful content but can cause a high amount of power consumption when displayed with light emitting pixels can be dimmed. This includes, for example, large extraneous areas of white space that do not include any text or graphics. Other regions of the image frame that include useful content can be left in their original un-dimmed state such that the usability of the display device is not affected.

In one embodiment, the amount of intensity reduction applied to one image frame depends on the amount of intensity reduction applied in previous image frames. With each frame, the amount of intensity reduction can be increased. This allows a region of an image frame to be gradually dimmed over time such that the effect of the dimming will not be noticeable to the user. The dimming may also be delayed until it is determined that a region of the image frames has not changed for a pre-determined length of time.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

The teachings of the embodiments of the present disclosure can be readily understood by considering the following detailed description in conjunction with the accompanying drawings.

DETAILED DESCRIPTION OF EMBODIMENTS

The figures and the following description relate to preferred embodiments of the present disclosure by way of illustration only. It should be noted that from the following discussion, alternative embodiments of the structures and methods disclosed herein will be readily recognized as viable alternatives that may be employed without departing from the principles of the claimed invention.

Reference will now be made in detail to several embodiments of the present disclosure, examples of which are illustrated in the accompanying figures. It is noted that wherever practicable similar or like reference numbers may be used in the figures and may indicate similar or like functionality. The figures depict embodiments of the present disclosure for purposes of illustration only. One skilled in the art will readily recognize from the following description that alternative embodiments of the structures and methods illustrated herein may be employed without departing from the principles of the embodiments described herein.

Figure 1:
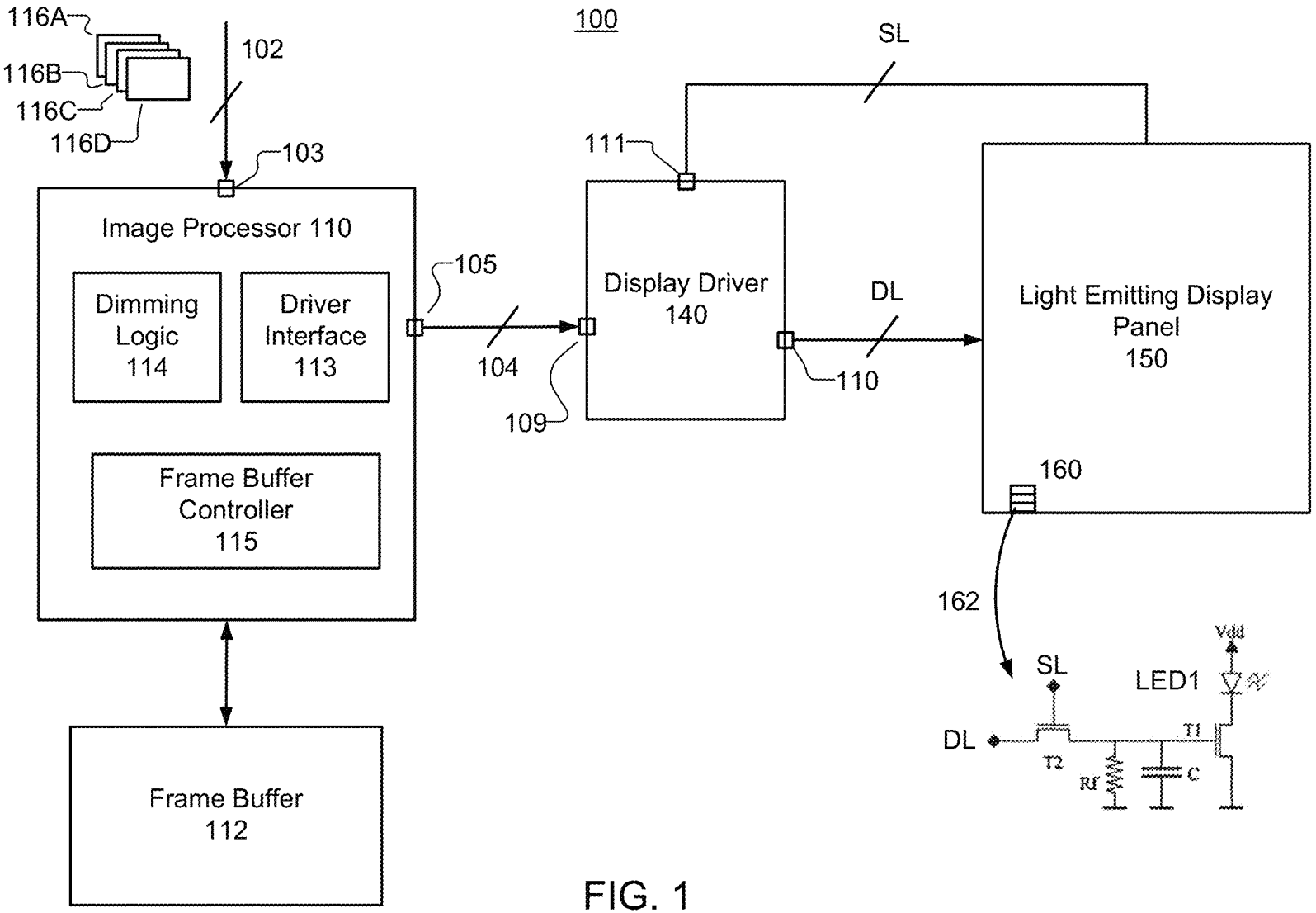
FIG. 1 is high level overview of a display device with selective dimming, according to an embodiment.

FIG. 1 is high level overview of a display device 100 with selective dimming, according to an embodiment. The display device 100 includes an image processor 110, a frame buffer 112, a display driver 140, and a light emitting display panel 150. In some embodiments, the display device 100 can represent a computer monitor, a television, a laptop computer, a tablet computer, or a smartphone. The display device 100 may also include other components that are not shown in the figure.

The light emitting display panel 150 includes many light emitting pixels 160 that emit light when activated. The light emitting display panel 150 may include many light emitting pixels 160 that are organized into columns and rows, although only one pixel 160 is shown in FIG. 1. Each of the pixels 160 can be sub-divided into sub-pixels 162 that emit light of different colors. For example, one sub-pixel 162 may emit red light, one sub-pixel 162 may emit green light, and another sub-pixel 162 may emit blue light. In other embodiments, the sub-pixels 162 may include additional or alternative colors.

Each sub-pixel 162 includes a light emitting diode LED1, such as an organic light emitting diode (OLED). The light emitting diode LED1 emits light in accordance with an amount of current flowing through the LED1. To set the brightness of the sub-pixel 162, an analog data voltage is provided on the data line DL by the display driver 140. Transistor T2 is closed by a pulse on the scan line SL and the capacitor C is charged up to the level of the analog data voltage. The voltage across the capacitor C turns on the transistor T1 and causes current to flow through the light emitting diode LED1. Rf represents the parasitic resistance of the sub-pixel 162.

Transistor T1 is operated in its forward-active region. So the precise level of the voltage across the capacitor C directly affects the amount of current flowing through LED1. As the voltage across the capacitor C increases, so does the current through the LED1, which in turns increases the brightness of the LED1 and the amount of power consumed by the LED1. Thus, when an image frame displayed with the panel 150 includes background regions with high intensity levels (e.g. white areas), the pixels 160, or more specifically the sub-pixels of the pixels 160, that are used to display those high intensity regions are driven with high currents and consume a high amount of power.

In other embodiment, the brightness of a sub-pixel can alternatively or additionally be controlled by adjusting the duty cycle of ON times and OFF times of transistor T1. The duty cycle refers to a percentage of time during which the transistor T1 is turned ON and causes LED1 to emit light. Duty cycle control can be used, for example, in 3D TVs where left eye and right eye image content will be displayed during time intervals.

The image processor 110 handles the bulk of the image processing in the display device 100, including selective dimming of image frames 116. In one embodiment, the image processor 110 is a system-on-chip (SoC), an application specific integrated circuit (ASIC), a general purpose processor, or a digital signal processor (DSP) that is specially adapted to perform the selective dimming operations described herein. The image processor 110 is coupled to a primary communications link 102 via one or more input ports 103. In one embodiment, primary communications link 102 is a video communications link carrying image frame data, such as an Red-Green-Blue (RGB) video link, YPbPr video link, Color Video Blanking and Synchronization (CVBS) video link, S-Video link, High-Definition Multimedia Interface (HDMI), Digital Video Interface (DVI), Display Port, etc. The image processor 110 is also coupled to a driver communications link 104 via one or more output ports 105. The primary communications link 102 and secondary communications link 104 may each be parallel links carrying multiple signals in parallel or serial links that carry serial data signals.

The image processor 110 receives, from the primary communications link 102, data for a series of images frames 116A-116D that are to be displayed on the display device 100. Each image frame 116 may include a large number of pixels 160 and include separate intensity information for the red, blue and green (RGB) colors of each pixel. For example, for each pixel, there may be 8 bits of intensity data for the color red, 8 bits of intensity data for the color green, and 8 bits of intensity data for the color blue. A digital intensity value of 0 may represent a low intensity level that corresponds to low pixel brightness, whereas a digital intensity value of 255 may represent a high intensity level that corresponds to high pixel brightness.

The image processor 110 includes a dimming logic 114, a driver interface 113, and a frame buffer controller 115. The frame buffer controller 115 interacts with the frame buffer 112 to manage the contents of the frame buffer 112. The frame buffer controller 115 can store the image frames 116 into the frame buffer 112 and retrieve the image frames 116 from the frame buffer 112 for processing by the image processor 110. In one embodiment, the frame buffer 116 is a volatile or non-volatile memory. In some embodiments, the frame buffer 112 may be located inside the image processor 110 instead of being external to the image processor 110.

The dimming logic 114 selectively dims (e.g. by reducing pixel intensity levels) static background regions of the image frames 116 to reduce power consumption of the display panel 150. In one embodiment, the dimming logic 114 may be implemented with circuitry that is specifically designed for performing selective dimming operations. In other embodiments, the dimming logic 114 may include executable instructions that perform the selective dimming operations when executed by the image processor 110.

The dimming logic 114 generally attempts to reduce pixel intensity levels in static background regions of the image frames 116 that have high intensity levels but include very little information that is useful to a user viewing the image frame. Regions of the image frames 116 that have high intensity levels are dimmed, whereas other regions of the image frame are not dimmed. For example, the dimmed regions of the image frame 116 may include blocks of white space, whereas the un-dimmed regions may include the text of a webpage. Beneficially, selective dimming of high intensity background regions increases the power efficiency of the display panel 150 without affecting regions of the image frames 116 that include useful information.

In one embodiment, the dimming logic 114 divides an image frame 116 into regions. For each of the regions, the dimming logic 114 determines one or more pixel intensity parameters from the pixel intensity levels in the region. The dimming logic 114 then determines if those pixel intensity parameters meet one or more dimming conditions. If dimming conditions are met, it indicates that the region represents a background of the image frame 116 and so the dimming logic 114 dims that region by reducing the pixel intensity levels of the region. The result is the generation of a dimming adjusted image frame can then be stored back into the frame buffer 112 for future display or passed directly to the driver interface 113 for immediate display. In some embodiments, the dimming adjusted image frame may have a different resolution than the original image frame 116.

Beneficially, selective dimming of bright static background regions of an image frame 116 results in significant power savings in display devices 100 that include light emitting pixels 160 (e.g. OLED pixels). In display devices 100 that include light emitting pixels 160, power consumption can be proportional to image pixel brightness so reducing the pixel brightness also reduces the power consumption of the display device 100. Additionally, the dimming is selective in nature and foreground regions of the image frame 116 containing useful information are not dimmed. Thus, power consumption can reduced without affecting the usability of the display device 100.

The driver interface circuit 113 interfaces with the driver communications link 104 to communicate with the display driver 140. The driver interface circuit 113 receives dimming adjusted image frames from the frame buffer controller 115 or dimming logic 114. The image frame data for the dimming adjusted image frame may include separate intensity data for the R, G and B intensity levels of each pixel of the image frame. The driver interface circuit 113 then transmits the image frame data for the dimming adjusted image frame to the display driver 140 for use by the display driver 140 in controlling the brightness of the light emitting pixels 160.

The display driver 140 controls brightness of the pixels 160 in the light emitting display panel 150 in accordance with the image frame data. In one embodiment, the display driver 140 is an integrated circuit (IC), or a combination of several ICs. In other embodiments, the display driver 140 may be part of the image processor 110. The display driver 140 is coupled to the driver communications link 104 via one or more input ports 109. The display driver 140 is also coupled to the data lines DL via one or more output ports 110 and the scan lines SL via one or more output ports 111. In some embodiments, the selective dimming functionality of the dimming logic 114 may be included in the display driver 140 instead of the image processor 110.

The display driver 140 includes digital-to-analog converters that the image frame data received via the driver communications link 104, which includes digital data, into analog data voltages. The analog data voltages are transmitted to the light emitting display panel 150 via the data lines DL as brightness control signals for driving the pixels 160 of the light emitting display panel 150. The display driver 140 also includes timing circuitry that generates timing control signals for applying the analog data voltages to the pixels 160. The timing control signals are transmitted to the light emitting display panel 150 via the scan lines SL. As a result of the control signals transmitted via the data lines DL and scan lines SL, a visual image corresponding to the dimming adjusted image frame is displayed by the display panel 150.

Figure 2A:
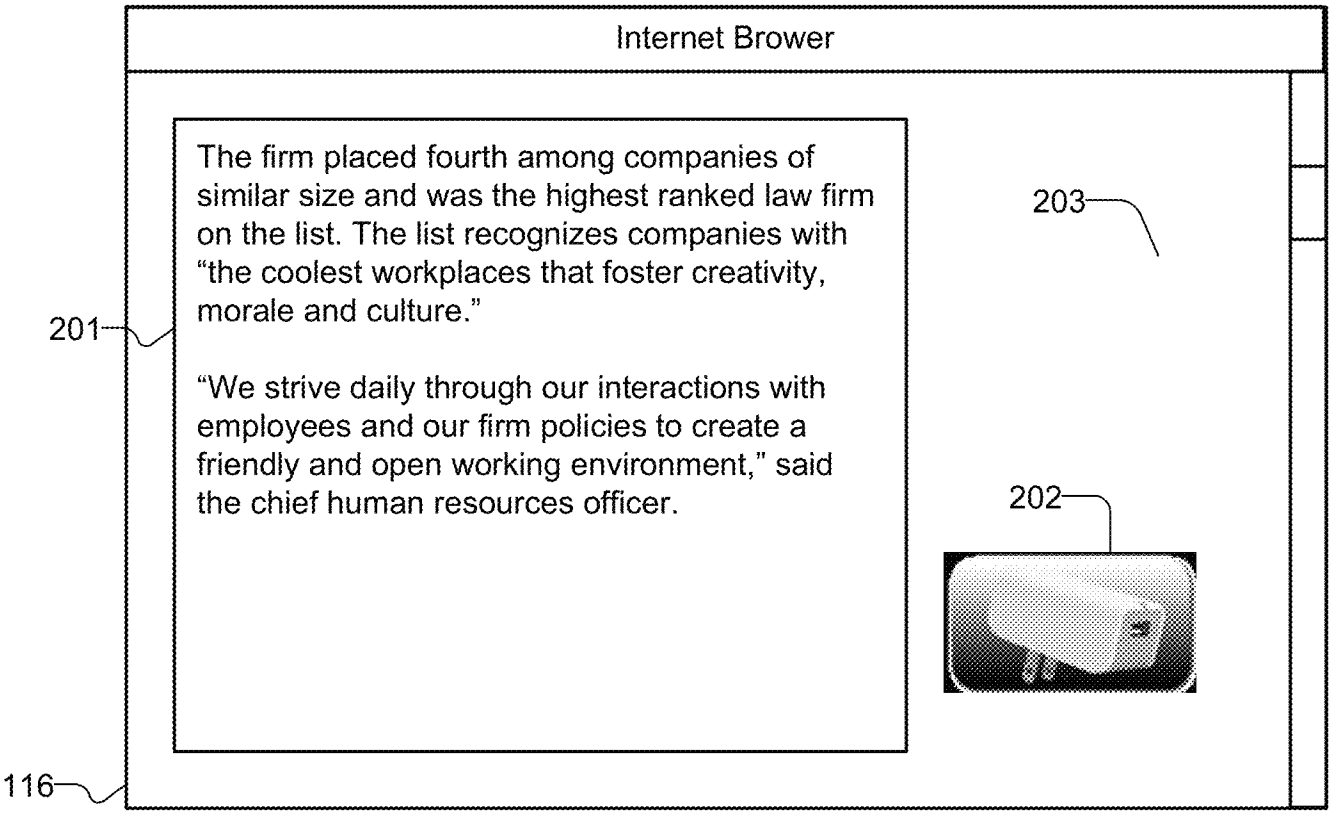
FIG. 2A is a visual representation of an unprocessed image frame, according to an embodiment.

Referring now to FIG. 2A, illustrated is an unprocessed image frame 116, according to an embodiment. This image frame 116 is received by the image processor 110 and represents a webpage that is to be displayed at the display device 100. Some areas of the image frame 116 include graphical objects such as text 201, graphics 202, and other visual elements such as the outline of a webpage and a scroll bar. These areas of the image frame 116 that include useful information represent the foreground of the image frame 116. Other areas of the image frame 116 include empty white space (e.g., 203) that represent the background of the image frame 116. These background areas of the image frame 116 typically cause the display device 100 to consume a high amount of power when displayed but do not include useful information for the viewer.

Figure 2B:
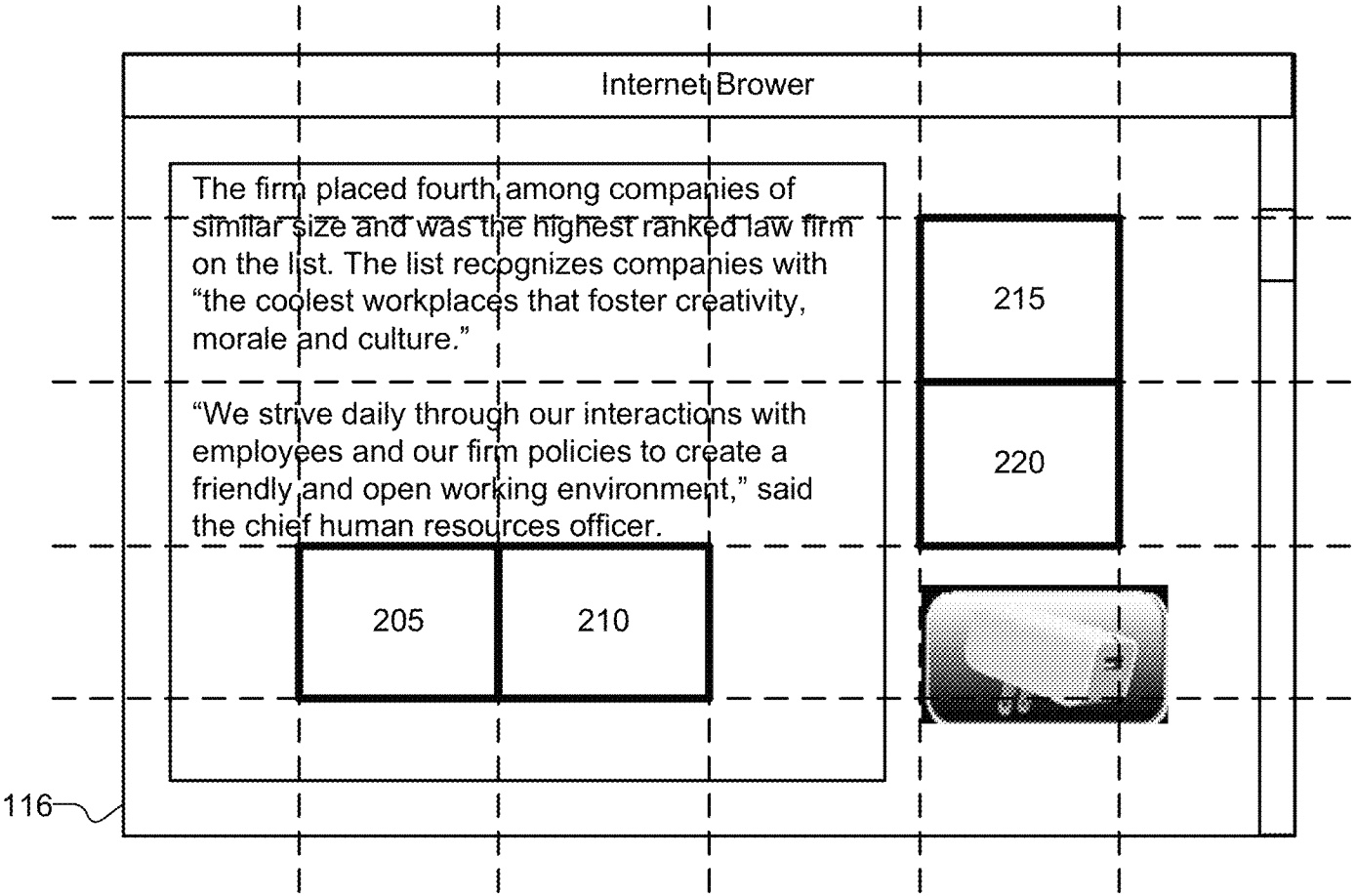
FIG. 2B is a visual representation of an image frame stored divided into regions, according to an embodiment.

FIG. 2B is the image frame 116 stored in an image processor 110 divided into regions, according to an embodiment. In one embodiment, the dimming logic 114 divides an image frame 116 into different regions and analyzes each region separately to determine if it should be dimmed. The image frame 116 is shown in FIG. 2B as being divided into thirty rectangular shaped regions. Each region is a portion of the image frame 116 that is smaller than the entirety of the image frame 116. In other embodiments, the image frame 116 may include greater or fewer number of regions and the regions may be of a different shape than that shown in FIG. 2B.

Several background regions 205, 210, 215, and 220 are shown with darker outlines. The dimming logic 114 selects these background regions 205, 210, 215 and 220 for dimming because they include only white space and little useful content that would be important to a user. By dimming these background regions, power consumption of the display device 100 can be reduced. Foreground regions of the image that include useful information (e.g. text, graphics) are not dimmed because the viewer will be focusing his/her attention on these regions. In other embodiments, other background regions of the image frame 116 other than those containing white space may be selected for dimming, depending on the dimming conditions applied by the dimming logic 114. For example, the background regions may be an area of the image frame 116 that primarily includes a solid color other than white (e.g. yellow, purple, blue, etc.).

Figure 2C:
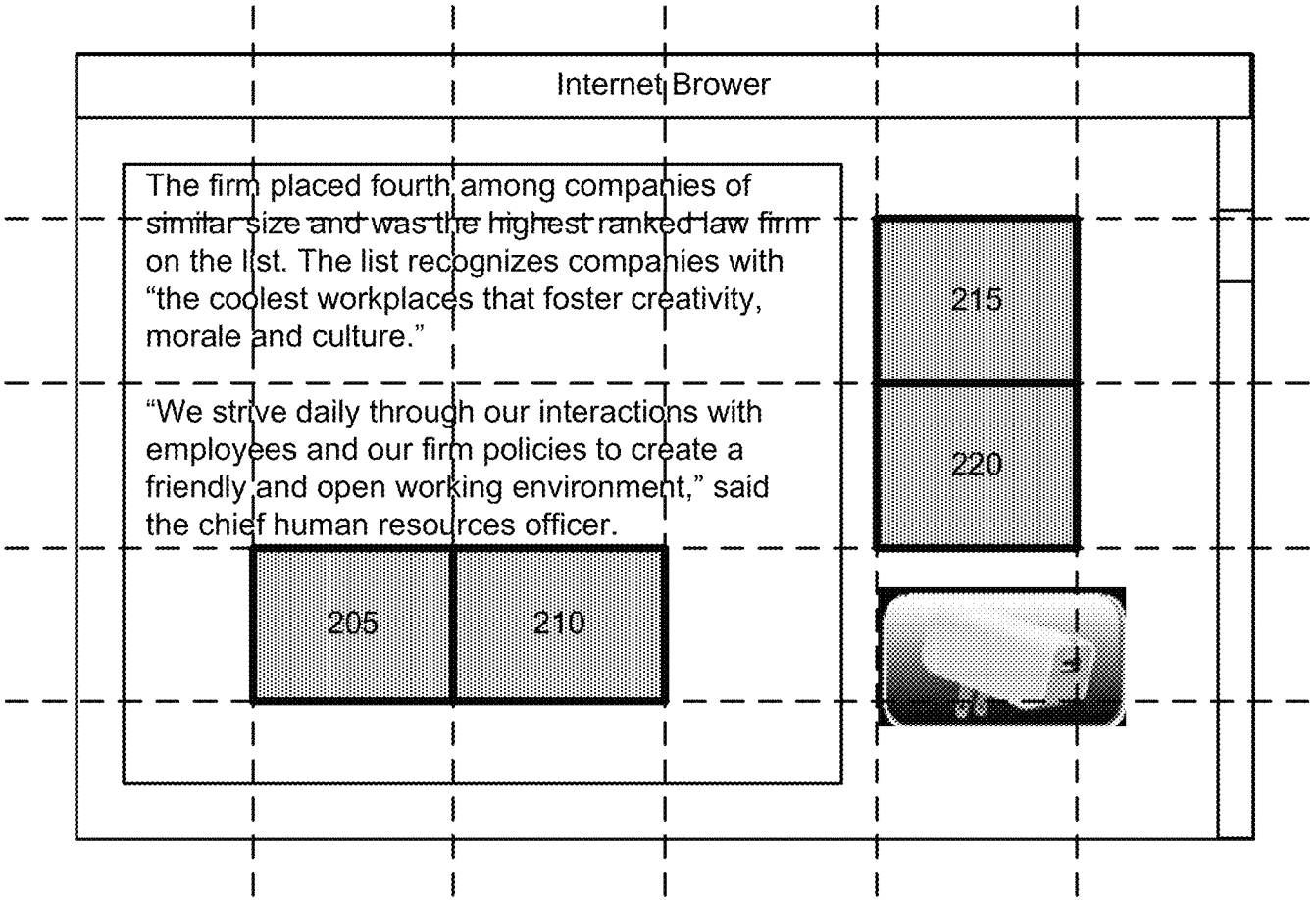
FIG. 2C is a visual representation of an image frame that includes dimmed regions, according to an embodiment.

FIG. 2C is an image frame 116 with dimmed regions, according to an embodiment. Regions 205, 210, 215 and 220 have been dimmed and are shown with darker shading. For example, the pixels in regions 205, 210, 215 and 220 may have their R, G and B intensity levels reduced by 15%-20% to make the pixels appear slightly gray in color. The level of the dimming is exaggerated in FIG. 2C for the purposes of illustration only. In practice, the dimming may be slight enough that a human user will barely be able to perceive the difference in intensity level between the dimmed background regions and the un-dimmed foreground regions.

Figure 3:
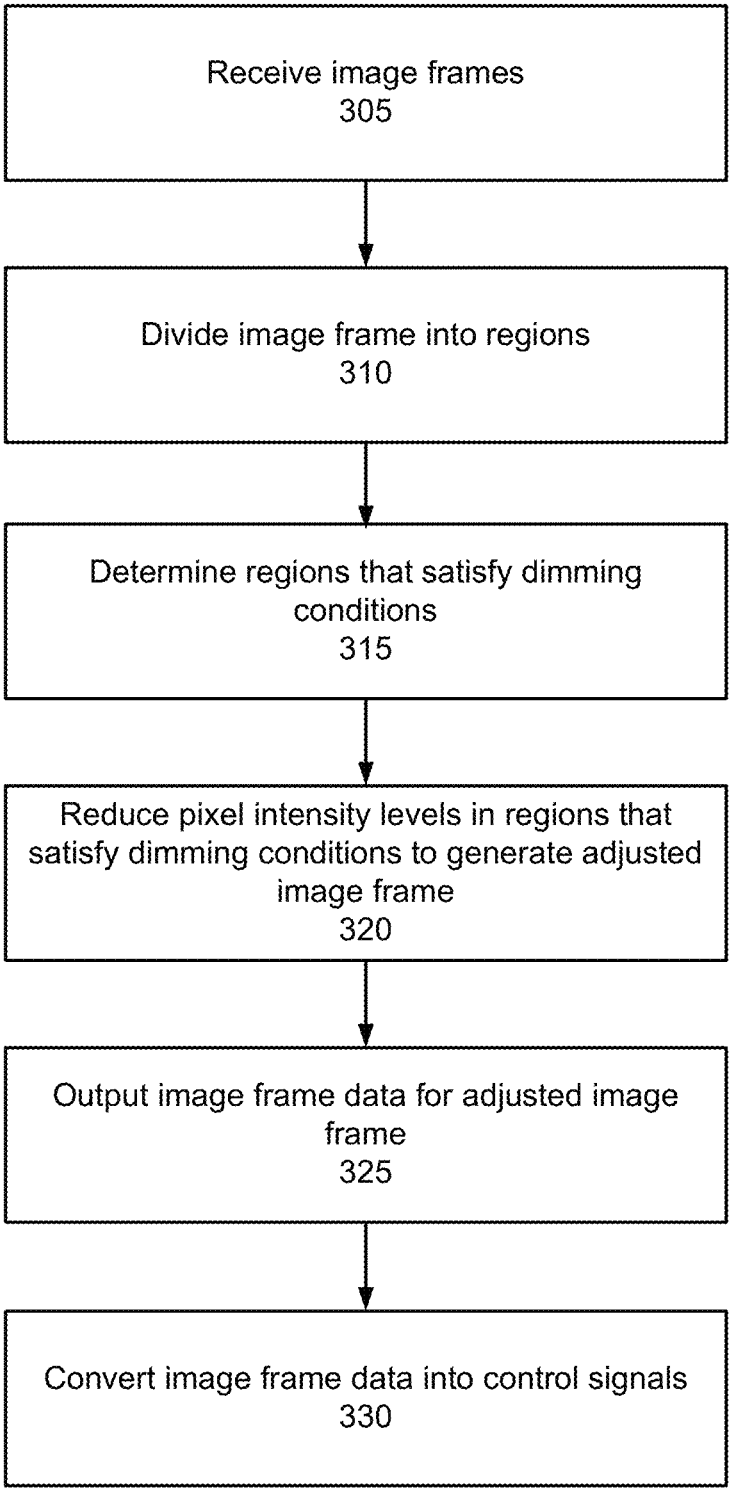
FIG. 3 is flowchart of a process for selective dimming performed by the image processor, according to an embodiment.

FIG. 3 is a flowchart for selective dimming performed in the display device 100, according to an embodiment. In step 305, the image processor 110 receives a series of images frames 116 and stores them into the frame buffer 112. In step 310, the image processor 110 divides each image frame 116 into several different regions, such as the regions shown in FIG. 2B.

In step 315, the image processor 110 analyzes each region individually to determine if the region satisfies one or more dimming conditions. In one embodiment, the image processor 110 analyzes the pixel intensity levels in a region (a "target region") and determines one or more pixel intensity parameters from the pixel intensity levels. A pixel intensity parameter can be the pixel intensity levels themselves or a value that is derived from and is representative of the pixel intensity levels. The image processor 110 then determines if one or more of the pixel intensity parameters satisfy one or more dimming conditions that are adapted for detecting background regions of the image frame. In other words, the pixel intensity parameters of a target region are used as an indication of whether the target region is within the background of the region frame.

The image processor 110 generally attempts to dim high intensity areas of the image frame that represent a background of the image frame and contain little useful information. To this end, examples of dimming conditions include the following conditions:

Average intensity condition—The average intensity condition is met if a parameter indicating the average intensity level for the target region exceeds a threshold amount of intensity (e.g. 90% intensity). The parameter indicating the average intensity for the target region can be determined by summing the R, G, and B intensity levels for each pixel in a region and dividing the total by the number of pixels in the target region. Other techniques for approximating the average intensity are also possible. A high average intensity indicates that the target region includes many bright pixels and so power can be saved if the region is dimmed.

Intensity difference condition—The intensity difference condition is met if a parameter indicative of an intensity difference between the brightest pixel and darkest pixel in the target region is less than a threshold difference in intensity (e.g. 10% difference in intensity). A small difference in intensity across a target region indicates that the region has fairly uniform pixel intensity and probably does not include any useful information.

Lowest intensity condition—The lowest intensity condition is met if the pixel intensity for every pixel or a substantial majority of pixels in the target region is greater than a threshold amount of intensity. If every pixel in the target region has a high level of intensity, this indicates that the target region includes mostly bright pixels and very little useful information.

Frame difference condition—The frame difference condition is met if a parameter indicating differences in intensity level between image frames indicates that the target region has not changed across a series of frames and is therefore static. A parameter indicating the difference between image frames can be determined by performing an exclusive or (XOR) operation of the target region across the current image frame and one or more previous image frames to compare the intensity levels. If a difference exists, this indicates that the target region includes changing intensity levels. Regions of the image frame that include changing intensity levels are not dimmed because these regions likely include information that the user is actively viewing, and dimming these regions could also result in distracting flickering. In practice, the frame difference condition effectively introduces a delay between when the target region stops changing and when the target region can be dimmed.

In step 320, the image processor 110 reduces pixel intensity levels in regions of the image frame that satisfy one or more of these dimming conditions to generate a dimming adjusted image frame. For example, the image processor 110 may only reduce pixel intensity levels to dim a region if all three of the following conditions are satisfied (1) the average intensity level of the region is above 90% (2) the maximum intensity difference is less than 10% and (3) there no change in the intensity levels of a region over the past 200 frames. In other embodiments, other conditions and combinations of the conditions are possible.

In one embodiment, the intensity levels in a target region can be reduced by associating the target region with lower intensity levels. New pixel intensity levels can be generated for the target region by using the existing pixel intensity levels as a baseline, and then lowering the existing pixel intensity levels in the target region to generate the new pixel intensity levels. The existing pixel intensity levels are then replaced with the new lower pixel intensity levels to generate a dimming adjusted image frame. The dimming adjusted image frame may then be stored back into the frame buffer 112 or passed to the display driver 140 for immediate display.

The amount of the intensity reduction may be set to a pre-determined level, such as a 15%-20% decrease in intensity level. Additionally, any or all of the individual R, G, B intensity levels in the target region may be reduced to achieve the targeted amount of dimming. In one embodiment, a frame may be dimmed as soon as the dimming conditions are met. For example, a target region may have 100% intensity during one frame and then dimmed to 85% intensity during the next immediate frame. In one embodiment, a pre-determined number of frames must pass once the dimming conditions are met before the target region is dimmed, which causes a delay in the dimming.

In another embodiment, the amount of intensity reduction may be progressively increased over a series of image frames so that the change in intensity does not appear abrupt. For example, the target region may have its intensity decreased in 0.5% increments over a series of 40 frames until the intensity level has decreased from 100% to 80%. The amount of intensity reduction for the target region of an image frame thus depends on the amount of intensity reduction for the target region in previous image frames. Beneficially, by gradually dimming the background regions as opposed to instantly dimming the background regions, the change in brightness may be slow enough that the user will not perceive that some portions of the image are being dimmed.

In step 325, the image processor 110 outputs image frame data for the dimming adjusted image frame to the display driver 140 for use in controlling the brightness of the light emitting pixels 160. The image frame data includes information for the pixel intensity levels of the dimmed regions of the dimming adjusted image frame. In step 330, the display driver 140 converts the image frame data into control signals (e.g. analog data voltages or duty cycle controlled signals) that are provided to the display panel for controlling current through, and therefore the brightness of, the pixels 160.

Upon reading this disclosure, those of skill in the art will appreciate still additional alternative designs for selective dimming in a display device. Thus, while particular embodiments and applications of the present disclosure have been illustrated and described, it is to be understood that the embodiments described herein are not limited to the precise construction and components disclosed herein and that various modifications, changes and variations which will be apparent to those skilled in the art may be made in the arrangement, operation and details of the method and apparatus of the present embodiments disclosed herein without departing from the spirit and scope of the disclosure as defined in the appended claims.

What is claimed is:

1. A display device with selective dimming, comprising:

a display panel including a plurality of light emitting pixels that emit light;

an image processor to divide an image frame into a plurality of regions and to generate an adjusted image frame by determining a maximum intensity difference between a lowest pixel intensity level and a highest pixel intensity level in a region of the plurality of regions and reducing pixel intensity levels in the region responsive to the maximum intensity difference in the region being less than a threshold difference in intensity; and a display driver to convert data for the adjusted image frame into control signals for controlling brightness of the light emitting pixels.

2. The display device of claim 1, wherein the image processor reduces the pixel intensity levels in the region by a current amount of intensity reduction that is determined based on a previous amount of intensity reduction of the region in a previous image frame.

3. The display device of claim 2, wherein the current amount of intensity reduction is higher than the previous amount of intensity reduction.

4. The display device of claim 1, wherein the image processor further determines an indication of differences in pixel intensity levels in the image frame relative to previous image frames and reduces the pixel intensity levels in the region responsive to the differences indicating a lack of change.

5. The display device of claim 1, wherein the light emitting pixels of the display panel are organic light emitting diode (OLED) pixels.

6. A method of operation in a display device that includes a display panel having a plurality of light emitting pixels, the method comprising:

dividing an image frame into a plurality of regions;

generating an adjusted image frame by determining a maximum intensity difference between a lowest pixel intensity level and a highest pixel intensity level in a region of the plurality of regions and reducing pixel intensity levels in the region responsive to the maximum intensity difference in the region being less than a threshold difference in intensity.

7. The method of claim 6, wherein reducing the pixel intensity levels comprises:

reducing the pixel intensity levels in the region by a current amount of intensity reduction that is determined based on a previous amount of intensity reduction of the region in a previous image frame.

8. The method of claim 7, wherein the current amount of intensity reduction is higher than the previous amount of intensity reduction.

9. The method of claim 6, wherein generating the adjusted image frame further comprises determining an indication of differences in pixel intensity levels in the image frame relative to previous image frames and reducing the pixel intensity levels in the region responsive to the differences indicating a lack of change.

10. The method of claim 6, wherein the light emitting pixels of the display panel are organic light emitting diode (OLED) pixels.

* * * * *